US007150682B2

(12) United States Patent
Varner

(10) Patent No.: US 7,150,682 B2
(45) Date of Patent: Dec. 19, 2006

(54) EXERCISE AND GOLF, BASEBALL AND OTHER SPORT TRAINING APPARATUS

(76) Inventor: David Varner, 1200 Roswell Rd., Suite 1, Marietta, GA (US) 36062

( * ) Notice: Subject to any disclaimer, the term of this patent is extended or adjusted under 35 U.S.C. 154(b) by 317 days.

(21) Appl. No.: 10/466,511

(22) PCT Filed: Dec. 20, 2001

(86) PCT No.: PCT/US01/50081

§ 371 (c)(1),
(2), (4) Date: Jul. 17, 2003

(87) PCT Pub. No.: WO02/051506

PCT Pub. Date: Jul. 4, 2002

(65) Prior Publication Data

US 2005/0014571 A1 Jan. 20, 2005

Related U.S. Application Data

(60) Provisional application No. 60/330,242, filed on Oct. 18, 2001, provisional application No. 60/269,433, filed on Feb. 16, 2001, provisional application No. 60/257,585, filed on Dec. 22, 2000.

(51) Int. Cl.
*A63B 69/36* (2006.01)

(52) U.S. Cl. ..... 473/257; 473/219; 473/223; 473/226; 473/422; 482/112

(58) Field of Classification Search ..... 473/219, 473/223, 226, 229, 257, 258; 482/112, 114, 482/121, 123, 129, 130, 138
See application file for complete search history.

(56) References Cited

U.S. PATENT DOCUMENTS

| | | | | |
|---|---|---|---|---|
| 254,108 | A * | 2/1882 | Bryon, Jr. | 482/129 |
| 655,671 | A * | 8/1900 | Crooker et al. | 607/78 |
| 3,428,312 | A * | 2/1969 | Machen | 482/123 |
| 4,231,568 | A * | 11/1980 | Riley et al. | 482/130 |
| 5,005,831 | A * | 4/1991 | Hara | 482/129 |
| 5,050,874 | A * | 9/1991 | Fitch | 482/130 |
| 5,284,464 | A * | 2/1994 | Lee et al. | 482/121 |
| 6,142,919 | A * | 11/2000 | Jorgensen | 482/121 |
| 6,228,004 | B1 * | 5/2001 | Steinbach et al. | 482/121 |
| 6,669,609 | B1 * | 12/2003 | Gerschefske et al. | 482/123 |
| 6,682,465 | B1 * | 1/2004 | Hawthorne | 482/121 |

* cited by examiner

*Primary Examiner*—Nini F. Legesse
(74) *Attorney, Agent, or Firm*—Smith, Gambrell & Russell, LLP

(57) ABSTRACT

A golf and other swing training and exercising apparatus including a base platform, a vertical support frame, a rotating swing arm connected between a grip and a resistance source which enables a user to execute a simulated golf or other swing by rotating the arm against the resistance. The structural configuration of the apparatus insures that minimum resistance to the correct swing execution is provided when the swing is executed with the proper body muscle groups and in the proper swing plane.

16 Claims, 13 Drawing Sheets

Fig. 3
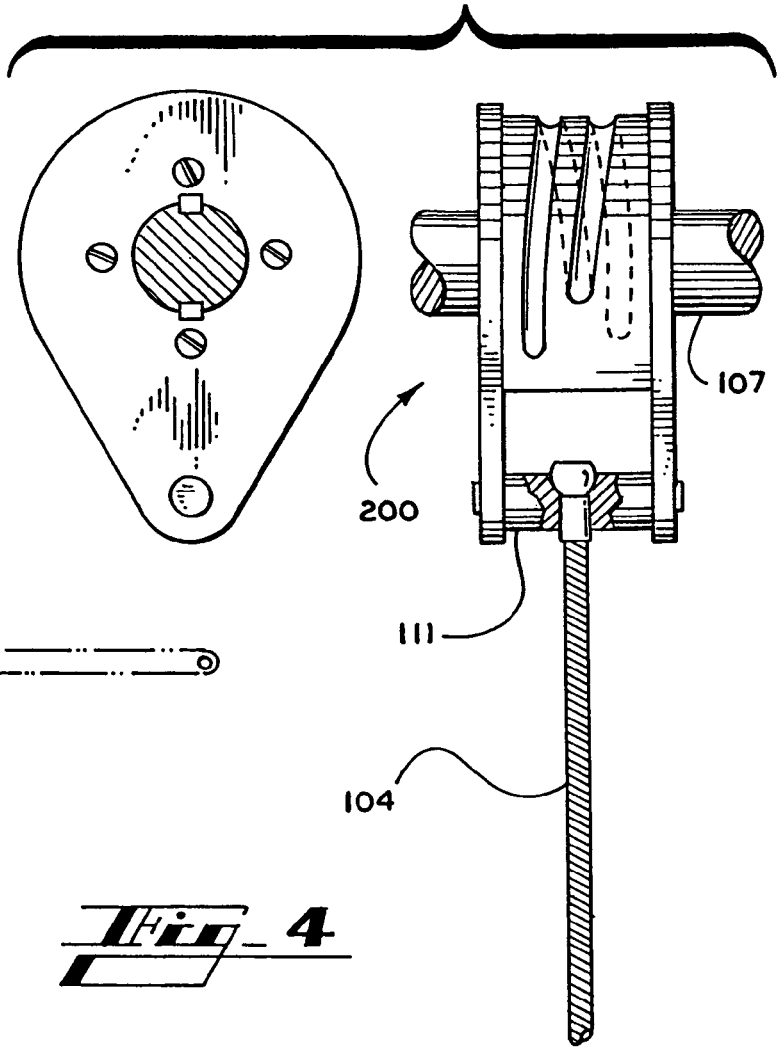
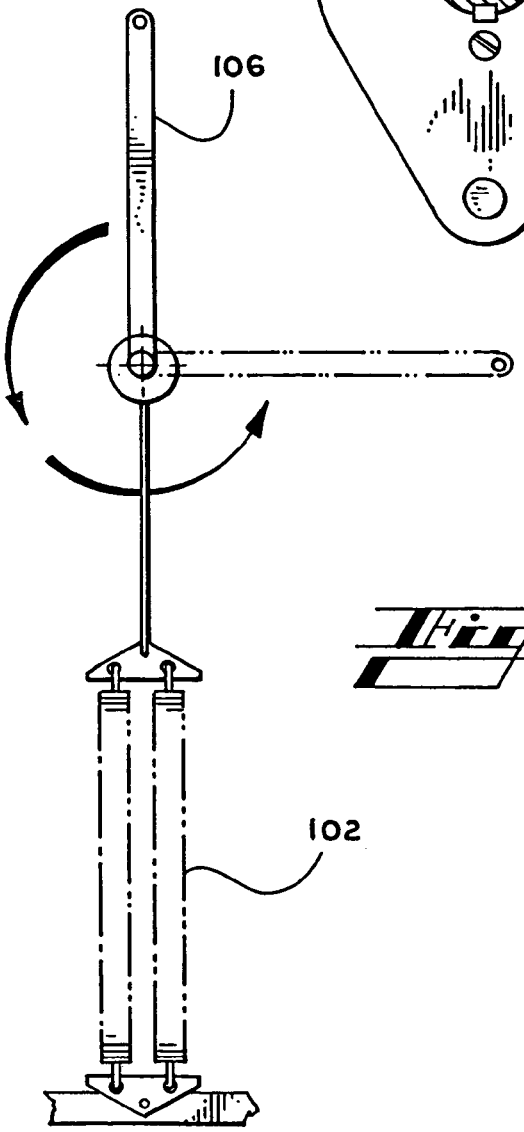
Fig. 4

EXERCISE AND GOLF, BASEBALL AND OTHER SPORT TRAINING APPARATUS

This application claims the benefit of the filing of U.S. Provisional Patent Applications Ser. No. 60/257,585 filed Dec. 22, 2000, 60/269,433 filed Feb. 16, 2001, 60/330,242 filed Oct. 18, 2001, and national stage PCT/US01/50081 filed Dec. 20, 2001.

FIELD OF THE INVENTION

This invention relates to sports training equipment and in particular to a machine used to improve a person's ability to perform the swing motions required in any one of a number of athletic games or sports.

The present invention also relates generally to golf swinging apparatuses and devices for developing the physical capabilities of a golfer and, more particularly, to a golf swing training and exercising device for developing the muscle groups of a golfer associated with a golf swing, such muscle training being accomplished with the assistance of a constant resistive force applied to the user during the course of both the backstroke and follow-through swing. The present invention is also useful as a physical therapy device for rehabilitating various injuries and ailments for which exercising of the golfing muscle groups will aid in rehabilitation.

BACKGROUND OF THE INVENTION

In athletic sports such as baseball, softball, golf, tennis, hockey, and the like, implements such as bats, clubs, rackets or sticks are swung to strike and propel a ball or puck. In each of these sports particular body positions, or stances, and particular swinging motions are used to achieve this. While there are certain differences between the stances, swing planes, and swing motions for baseball, golf, hockey, and tennis, there are also important similarities.

In most such swinging motions, the implement that is swung moves in a path that is generally a planar arc about a pivot point or axis. This path may not always be a perfect circular arc about a fixed pivot point in one plane, but the striking portion of the bat, club, stick, or racket moves in a path that generally approximates such a centrifugal arc. The central pivot point or axis of rotation for these athletic swinging motions lies in the vicinity of the inner side of the upper spinal column between the shoulders of the person performing the swing, more or less central to the upper torso and neck.

In each athletic swing, precise positional control of the swing path, through the striking point, is very important. Also, mechanical efficiency of the entire swing motion, acceleration and power all contribute to the effectiveness of hitting in these sports. Specific muscle coordination and strength are required of all of the muscles which come into play, and in some cases muscular endurance is also needed. Particular muscles in the legs, torso, shoulders, arms, forearms, wrists and hands all contribute to such swinging actions.

The present invention utilizes two well known and widely accepted training concepts to develop proficiency in particular athletic skills. The first is that muscle strength and endurance are developed by repeatedly contracting the muscles against resistance, through a particular range of motion; and the second is that training is specific. This means that training of a coordinated group of muscles used to perform a specific action can effectively be achieved by repeatedly performing the actual, specific event. Athletic maneuvers, such as proficiently swinging a bat, club or racket, require learning and repetitive training to improve muscular coordination, power and control.

In most sports requiring a ball to be struck and propelled by a swung implement, one of the primary objectives is to strike the ball with as much force as possible. In baseball, softball and golf, for example, it is often desirable to hit the ball as far as possible, and in tennis it is helpful to hit with control and velocity. This requires a high degree of muscular power along with good control of the swing path. The baseball swing seemingly requires the most muscle power because of the weight of the typical bat and the rapid acceleration that is required due to the very brief response time allowed by a fast pitch. This muscle strength can be developed most effectively by working all of the coordinated muscles involved, against resistance, through a critical range of motion. The most critical range of the swing motion, where the most strength is required, is from the starting position of the swing up to the point of contact with the ball. It is through this zone that the bat or club must be rapidly accelerated and driven, to maximize the force and momentum at the impact point. This momentum is the product of the fixed mass and impact velocity of the bat or club head. A continued driving force through impact also helps to overcome the opposite momentum of a baseball or resting inertia of a golf ball or the like. The follow through or completion of the swing after contact with the ball is important for assuring a proper and repeatable swing form, but not as important in terms of muscle strength.

The present invention provides a training device which accommodates a variety of particular swinging motions that apply to different athletic sports, while providing a variable resistance to such swings in the most appropriate realm of the swing path. By repeatedly using this device, the training effect can be achieved to improve the proficiency of a trainee's ability to perform such swings in the actual events.

It is also desirable to be able to develop efficient, powerful swing motions in either a clockwise or counter clockwise direction. There are, in all sports, both right-handed and left-handed swingers. In tennis, moreover, the ball may be struck with a forward swing that can be either a forehand or backhand stroke, and in baseball it is beneficial to be able to swing equally well from either side of the plate to compensate for right or left-handed pitchers. The present invention accommodates both forward swing directions and is particularly well suited for developing this switch hitting capability. In cases involving swinging a bat, golf club or racket, such actual implements may be used in prior art training, but the present invention utilizes a special swing implement which replicates that of the appropriate bat, club, etc.

One embodiment of the present invention relates to a baseball training device adopted for teaching players correct striking force and movement.

It is a common knowledge that one of the most important skills for a baseball player is an eye and hand coordination and the ability to strike a ball at a precise place, so called "soft spot", to carry the ball to a desired distance. Various teaching devices have been known for training beginner players, some of the teaching tools including a vertically mounted upright standard with a ball tethered to the standard on either a solid support arm or a flexible tether string.

The devices that utilize a rigid support arm hold a baseball in a fixed position, allowing the arm to rotate about the standard following a strike by a player. The devices that use a tether line allow the ball to freely spin about the standard and come to rest under gravity. The ball in a flexible tether system is usually suspended from a horizontal arm extending from the upright standard and offers virtually no resistance to a striking force exerted by the player. Such systems do not allow a player to develop the necessary skills to apply the correct amount of force to strike the ball. As a result, it is difficult to teach the player the correct amount of force that needs to be applied to hit a ball that moves at a considerable speed toward the player.

Devices provided in the past for improving a practice swing of a golf club, baseball bat, or the like, generally have been restricted to either improving the path of a swing or a particular portion of the swing.

The present invention relates to a golf swing training and muscle exercising apparatus which enables a user to simulate the movements of a proper swing and which also exercises the muscles of the golfer making such a swing, combined in a single apparatus.

In playing the game of golf, optimum shot making performance is achieved when a golf club is swung on a precise plane using specific muscle groups to maximize the energy transfer from the club head to a golf ball. In learning to play the game, many natural tendencies, often learned from playing other sports, must be overcome to properly position the club head relative to a ball during a swing. For example, the property executed swing requires that a club be swung on an inside to outside path bringing the club head square with respect to the ball at impact using the large muscles of the body in combination with the hands to maximize the power generated during the swing.

Whereas the concepts appear relatively simple, particularly when executed by a highly proficient golfer, in fact it is often difficult, if not impossible, for a beginner to properly train himself in the development and execution of a golf swing. In this regard, many beginning and also experienced players seek the assistance of teaching professionals to learn the fundamentals and also to improve a previously developed golf swing. Using this teacher method, it is usually possible to provide only visual and audible feedback to the player therefore leaving the player to develop the proper swing movements by himself based on this feedback.

Many attempts have been made to provide training and/or exercising devices which enable a golfer to execute a proper golf swing so that a golfer has physical feedback of the swing motion. There have also been a number of exercise devices which are designed to stimulate and strengthen specific muscle groups attuned to the swinging of a golf club.

Among the prior art patents relating to such swing training devices are U.S. Pat. No. 3,703,294 for Golf Swing Training Apparatus. Other prior art patents which are designed to exercise golf muscles are U.S. Pat. No. 2,848,234 for Golf Swing Conditioner and U.S. Pat. No. 3,614,108 for a Golf Practice Device.

There are a number of prior art devices which are specifically designed to teach a player the proper swing movements and swing plane positions of a golf club during a golf swing as shown by U.S. Pat. No. 1,893,920 for Golf Swing Device, U.S. Pat. No. 2,328,408 for Golf Stroke Teaching Machine, U.S. Pat. No. 2,458,932 for Golf Practicing and Teaching Apparatus, U.S. Pat. No. 2,788,214 for Golf Teaching and Practicing Device, U.S. Pat. No. 3,319,963 for Golf Swing Guiding Device Including Correct Swing Indicator, U.S. Pat. No. 3,429,571 for Programmed Swing Training Device, U.S. Pat. No. 3,462,156 for Golf Practice Device, U.S. Pat. No. 3,738,661 for Golf Exercising Device, U.S. Pat. No. 4,262,573 for Golf Swing Simulator Device, U.S. Pat. No. 4,580,786 for Device For Controlling Golf Swing, and U.S. Pat. No. 4,653,757 for Golf Swing Training Apparatus among a number of others.

Whereas the majority of the prior art works somewhat for their intended purposes, they are often complex in nature requiring sophisticated manufacturing and/or installation procedures. Further shortcomings, particularly with the more simple prior art devices, permit the golf club to be swung in a number of different planes while just generally simulating the golf swing arc which actually can train the golfer to make improper swing movements: The prior art exercising devices do not consider the position and plane of the golf club during the exercise device except in a most general way.

When making a golf swing, a line of force which moves the golf club to strike the ball starts with the golfer's pulling motion. This pulling motion follows a parabolic arc which has a starting point above and distal to the golfer's right shoulder. This arc needs leverage to gain momentum and reach increased velocity quickly. The human body is designed in a way which predetermines the best leverage. The golfer's legs, hips, spine, shoulders, arms and hands are the levers.

The body's mechanical levers need to be used to put the golf club in position at the top of the back-swing in as simple or least complicated means as possible. The swing training machine of the present invention has a lever arm that rotates as the golfer swings, thus the resistance for the golfer comes from behind the golfer's swing plane; or from pulling. This resistance to the centrifugal force of the swing must come from a moving arm. When the golfer's leverage is out of alignment with the resistance from the arc arm, the centrifugal force is destroyed and becomes ineffective thus losing leverage and causing restraint.

To strike a golf ball, the force comes from behind the ball and goes forward with the force of the club head at right angles to the target, and a force line directed toward the target will send the golf ball straight to the target.

An improper spinning force right to left will cause the ball to hook. A ball spinning left to right will slice, and a ball with backspin at 21 revolutions will go straight. The ball may go higher or lower in trajectory, but not off line.

In U.S. Pat. No. 4,229,002 there is provided a golf swing exercise device which may be utilized indoors. It provides a T-shaped support beam. A golf grip and part of a golf club shaft is securely attached to one end of a rope and a weight is attached to the opposite end of the rope. The rope passes through pulleys secured to the support beam. The user exercises by grasping the golf grip and simulating a golf swing which reciprocates the weight attached to the rope. Since there is only one rope involved, the nature of the forces applied to the simulated golf club are restricted.

In U.S. Pat. No. 3,966,203 there is provided a golf swing practice and exercise device in which a free fall weight moves vertically along an open-ended guide tube. A cord is attached at one of the weights and passes through a guide eye at the top of the tube and through a second guide farther down the tube and terminates in a sock which can be attached to the head of a golf club. The cord applies a restraining pull to the golf club head to vary the degree of exercise obtained in use. Again the device is restricted to a single cord and is limited in the nature of the forces which can be applied.

U.S. Pat. No. 4,181,310 shows an apparatus for analyzing the movement of a golf swing. A first line is provided between a measuring device and the golf club head and a second line between a measuring device and the player's body. The purpose of the device is one of analyzing rather than exercising and the fact that only one line is provided to the golf club head imposes limitations.

U.S. Pat. No. 4,034,991 shows a device for use in manipulating a golf club swing. A weighted member such as a slider is secured to another member for guiding the slider through a predetermined path. A pair of flexible cords are secured to a pair of spaced apart posts and engage both the slider and the golf club head. As the user swings the golf club the slider is caused to follow a predetermined path causing the flexible cords to become taut, or slack, at predetermined points through the swing. In this fashion the golf head is caused to be swung to accelerate at maximum speed through the point of contact with the ball. Although two flexible cords are provided in this configuration, they function in a fashion such that they tend to control the action of the swing without providing much in the way of muscle tone improving features, and without providing resistance as the swing moves the golf head through the ball impact zone.

U.S. Pat. No. 4,225,133 discloses a device for teaching batting techniques which includes a base platform having a well for the batter's aft or rear foot, an arm that provides a yieldable barrier for the batter's forward foot, and a cord or cable that checks the batter's swing at levels above his strike zone. U.S. Pat. No. 4,577,868 discloses a golf swing training device which includes a plurality of aligned pressure sensors for detecting the golfer's shifting weight during the golf swing and memory circuits that are utilized to issue alarms advising the golfer of the proper weight shifts during the golf swing. U.S. Pat. No. 4,955,608 discloses an athletic movement trainer used by tennis players. The trainer has straps that attach to the ankles of the tennis player and a cord extending from those ankle straps to a loop on a belt around the waist of the tennis player.

The prior art is well documented with golf swing exercising and training devices for use in developing the muscular capability of a golfer. The purpose behind such devices generally is to improved both the mechanics and amount of force capable of being applied by a golfer during a golf swing.

U.S. Pat. No. 4,984,801 teaches a golf swing muscle strengthener device which consists of a structural member attached to a conventional golf club, the member including being clamped to the handle of the club and including a plurality of weights which are suspended from the member so that they are directly below the golfer's grip. U.S. Pat. No. 5,209,481 teaches another type of golf swing strengthening device which incorporates just the handle portion of a golf club and which again includes a selective plurality of weights which are secured to a downwardly extending end of an elongate member.

A further type of golf swing muscle developer is disclosed in U.S. Pat. Nos. 4,135,714 and 4,253,663. The '714 patent discloses a flexible cord attached to and wound around a spring loaded or spring-retarded pulley mounted to a wall or other stationary vertical support surface. An elongate handle is attached to a free end of the flexible cord remote from the pulley and, upon repetitive use by a golfer, strains and strengthens the muscles of the user. The '663 patent is similar to the '714 disclosure and also teaches a U-shaped mounting bracket design which is capable of being mounted over a horizontal top of a door or other support.

A further type of muscle strengthener device is disclosed in U.S. Pat. No. 3,876,212 which teaches an arched overhead support which is mounted on rollers so as to be rotated about a fixed axis to selected positions on a supporting surface. A downwardly extending and slidably movable mechanism is secured to the arched overhead support and includes three movably interconnected shafts, the lowermost of which is adapted to be connected to the implement to be swung. A system including hydraulic fluid, valves, electrical sensors and electrical actuators is provided either for detecting movements of the shafts or causing selected movements of the shafts. Unlike, the other cited references, this device does not appear to disclose any means for establishing or adjusting a resistive force during either the backstroke or follow through swing of the user.

A further type of golf practice apparatus is disclosed in U.S. Pat. No. 5,737,432, which teaches a device capable of positioning the golfer and coordinating the golfer's movements in a controlled manner. The '432 patent teaches structure for positioning the golfer's head during the mechanics of the follow through swing, as well as the golfer's midsection and in addition provides an elevated platform upon which the golfer stands, however this patent does not teach or suggest generating a constant and resistive force for developing the golfing muscles of the user.

U.S. Pat. No. 4,583,740 teaches a further type of golf swing training device in which the golfing muscles of the user are exercised and which discloses a tubular guide for directing a modified golf club, the club including a disc-shaped and weighted slide which is affixed to the club shaft and slidably engaged within the tubular guide. The weight slide is removable and can be replaced with other varying weights so as to vary the amount of resistive force. Also disclosed in the Golf Training Systems brochure is a swing development device which appears to include an upwardly extending body and, connected thereto, a cord and handle for applying resistive support to the user.

SUMMARY OF THE INVENTION

Accordingly, it is an important object of the present invention to provide an exercise device that is capable of being used by any individual who would like to improve his or her swing relating to the different types of sports wherein the wrist, arm and shoulder muscles play an important part in the playing of the game. In tennis, racket ball, baseball and golf one must develop a swing action. Therefore, the present invention provides a means to exercise the related muscles while using the device in a similar action as required in the above-mentioned sports.

BRIEF DESCRIPTION OF THE DRAWINGS

FIG. 1 shows the apparatus of the present invention in the vertical position with a platform which rests on a floor surface.

FIG. 3 is a side view and an end view of the novel two-way spool of the present invention, which provides both clockwise and counter-clockwise motion of the actuator arm.

FIG. 4 is a schematic depiction of the extension springs, attachments, and the arm showing the rotation.

DESCRIPTION OF THE PREFERRED EMBODIMENTS

Figure 1:
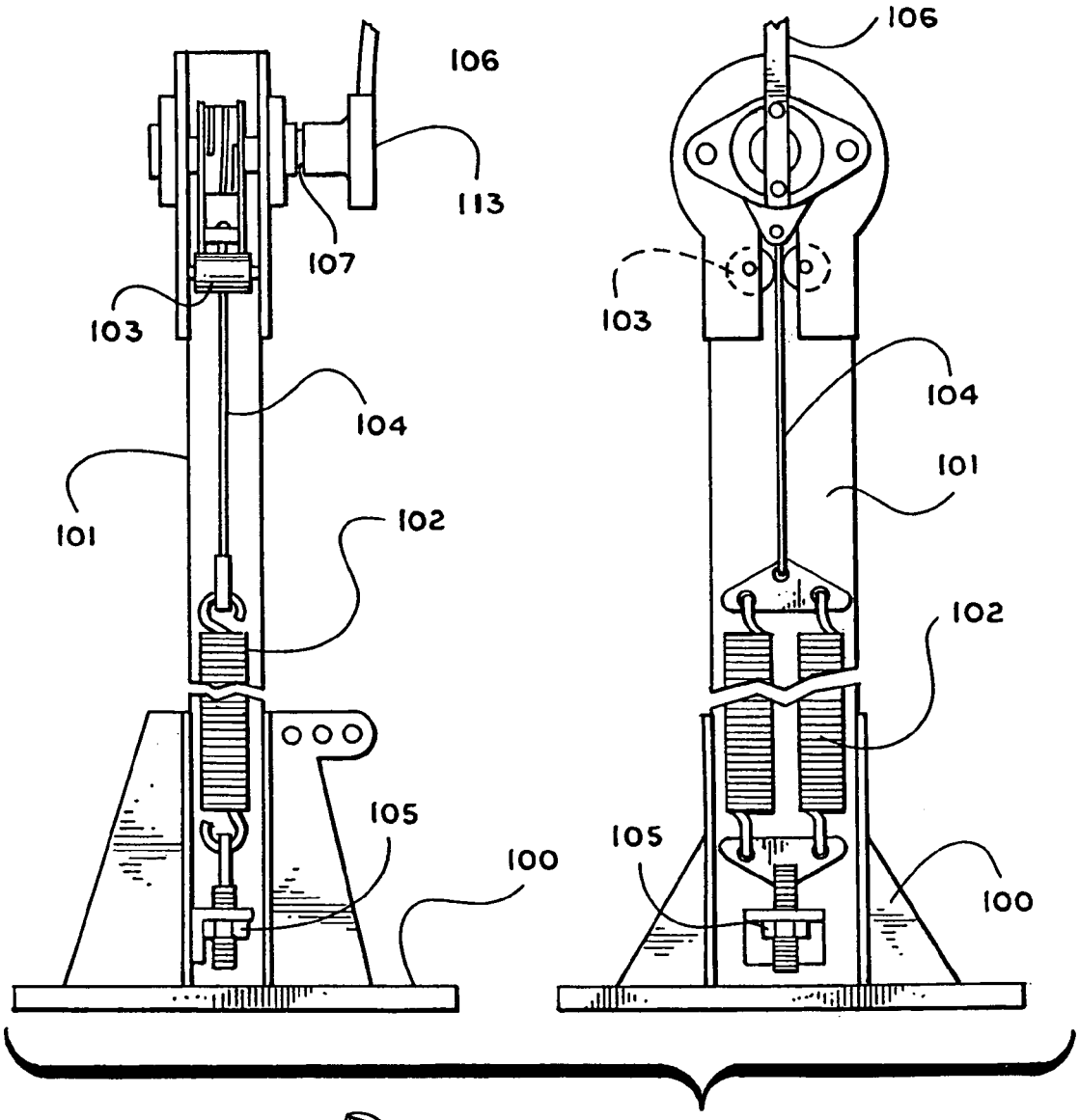
FIG. 1 is a side sectional view of one embodiment of the apparatus of the present invention with the major parts labeled.

As can be seen from FIG. 1, the apparatus of the present invention is uniquely suited for improving the strength and technique for swinging a golf club. A user can place one or both hands on the hand grip which is advantageously padded and/or formed to fit a human's grip and by pulling down the flexible linkage allows a full range of motion both clockwise and counterclockwise, thereby accommodating both left and right handed users.

The apparatus of the invention is also useful for exercise to strengthen the torso, deltoids, shoulders, etc., when the apparatus is in the vertical position. The apparatus may also be placed in the horizontal position where it can be used to strengthen the pectorals, lats and other muscles. When in this position the apparatus is particularly useful in training for baseball, tennis, handball and the like to strengthen and improve the swinging motion required in those sports.

FIG. 1 shows the preferred resistance as being a coil or set of coils, or spring(s), however, the resistance means can also be an air or other fluid piston or a combination of such a piston and a resistance coil.

As can be seen from the figures and description, one embodiment of the present invention, in addition to a novel exercise apparatus, is a novel golf, baseball, or other sport swing training and strengthening device for simulating the proper swing path and for exercising the swing muscles comprising:

a base;

a housing connected to said base and extending in a generally vertical direction therefrom;

a swing or actuator arm having a vertical proximal end rotatably attached to said housing by a shaft which rotates with said swing or actuator arm and extending toward a user of said apparatus and having a distal end terminating in a generally horizontal direction thereto;

a flexible linkage member connected to said distal end of said swing arm for permitting universal movement between said member and said swing arm;

a resistance means and a linkage means operably corrected to the resistance means;

the resistance means cooperating with said shaft for providing resistance to movement of said swing arm when said swing arm is rotated by a user during the simulation of a swing; and said linkage being moveable in either clockwise or counterclockwise direction against said resistance.

As can be further seen from the figures and description, one embodiment of the present invention, is a novel exercise apparatus and a novel golf, baseball, or other sport swing training and strengthening device for simulating the proper swing path and for exercising the swing muscles comprising:

a base;

a housing connected to said base and extending in a generally vertical direction therefrom;

a swing or actuator arm having a vertical proximal end rotatably attached to said housing by a shaft which rotates with said swing or actuator arm and extending toward a user of said apparatus and having a distal end terminating in a generally horizontal direction thereto;

a flexible linkage member connected to said distal end of said swing or actuator arm for permitting universal movement between said member and said swing or actuator arm;

a resistance means and a linkage means operably corrected to the resistance means;

the resistance means cooperating with said shaft for providing resistance to movement of said swing or actuator arm when said swing or actuator arm is rotated by a user during the simulation of a swing;

a grip means connected to said flexible linkage member; and said swing or actuator arm being moveable in either clockwise or counterclockwise direction against said resistance.

Another embodiment of the present invention is a golf swing training and exercise apparatus for simulating the proper swing path and for exercising the golf swing muscles comprising:

a base;

a mounting frame connected to said base and extending in a generally vertical direction;

a swing arm having a vertical proximal end rotatably attached to said mounting frame by a shaft which rotates with said swing arm and extending in an arcuate configuration toward a user of said apparatus and having a distal end terminating in a generally horizontal direction;

a grip means;

a linkage member connecting said grip means to said distal end of said swing arm for permitting flexible, universal movement between said grip means and said swing arm;

a resistance means cooperating with said shaft for providing resistance to movement of said swing arm when said swing arm is rotated by said user during the simulation of a golf swing; and said swing arm being moveable in either clockwise or counterclockwise direction against said resistance means.

Advantageously, the apparatus base is a platform extending in a horizontal plane and structured to support a user on a flat surface. Preferably the swing arm is a rigid, metallic rod.

Advantageously in the apparatus of the present invention said resistance means includes a pulley attached to said shaft and a cable, one end of which is wound on said pulley and the other end of which is attached to a resistance. Preferably said resistance is at least one spring.

Another embodiment of the present invention is a golf or other club, bat, racket, or like swing training and exercise apparatus for simulating the proper swing path and for exercising the swing muscles, comprising:

a base;

a housing connected to the base and extending upwardly from the base;

a resistance means and a linkage means supported in said housing, the linkage means being operably connected to the resistance means at one end and to a swing arm at the other end;

said linkage means being moveable in either as clockwise or counterclockwise direction against said resistance, thereby resisting the movement of said swing arm; said linkage means being formed of a 2-way spool rigidly attached to a rotatable shaft, said linkage means further including a flexible connection means operably connected to said spool and arranged to the wound around said spool upon rotation in either a clockwise or a counterclockwise direction, said flexible connection means being connected to said resistance means whereby movement of said flexible connection means around said spool increases said resistance, providing rotational resistance to the rotational movement of the shaft; and grip means connected to a distal end of said swing arm whereby movement of the grip means in either a clockwise or counterclockwise direction creates resistance to exercise the muscles.

Advantageously the apparatus of the present invention has adjustment means which includes a pivotably mounted adjustment bolt structured to be positioned in a plurality of tension settings.

The present apparatus advantageously includes a sphere as the grip means. Alternately the present apparatus includes a handle as the grip means. Preferably said handle is rotatable about its horizontal axis.

One embodiment of the apparatus of the present invention includes a rope as the linkage member. Another embodiment of the apparatus of the present invention includes a cable as the linkage member. A further embodiment of the apparatus of the present invention includes a chain as the linkage member. Yet another embodiment of the apparatus of the present invention includes a belt as the linkage member. One embodiment of the apparatus of the present invention includes a rope as the linkage means. Another embodiment of the apparatus of the present invention includes a cable as the linkage means. A further embodiment of the apparatus of the present invention includes a chain as the linkage means. Yet another embodiment of the apparatus of the present invention includes a belt as the linkage means.

Figure 6:
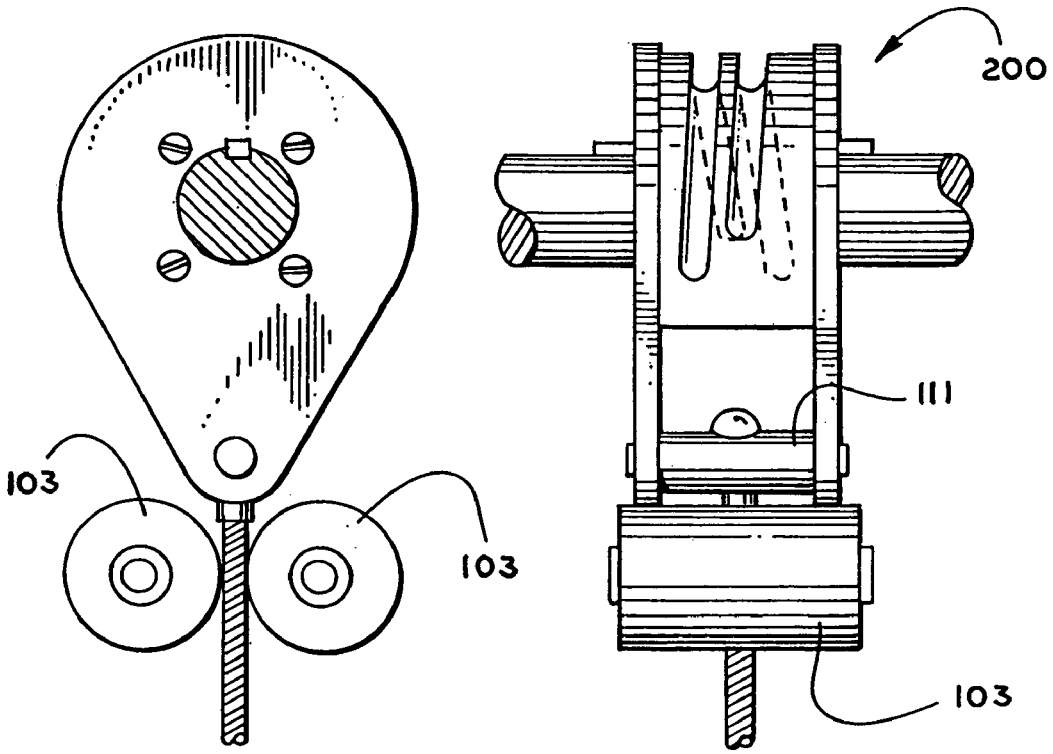
FIG. 6 is a side and an end view of the suspension plates, two-way spool, leverage reducing guide rollers and orbital spooling linkage.
Figure 7:
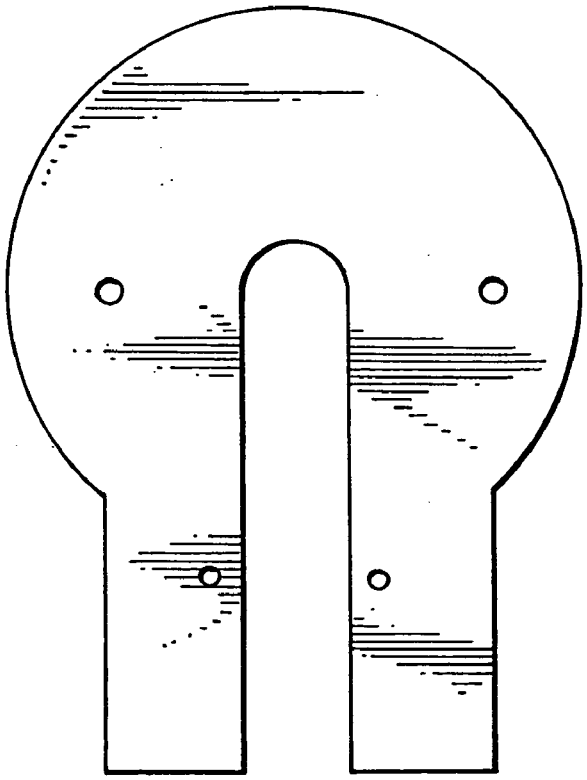
FIG. 7 depicts the two-way spool housing through which the leverage reducing guide rollers are attached.
Figure 8:
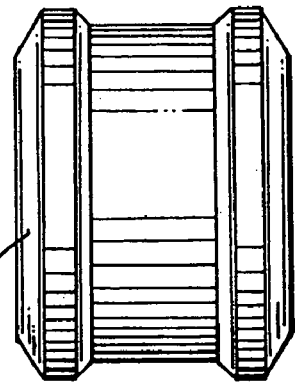
FIG. 8 is a schematic depiction of one embodiment of the guide roller of the present invention.
Figure 9:
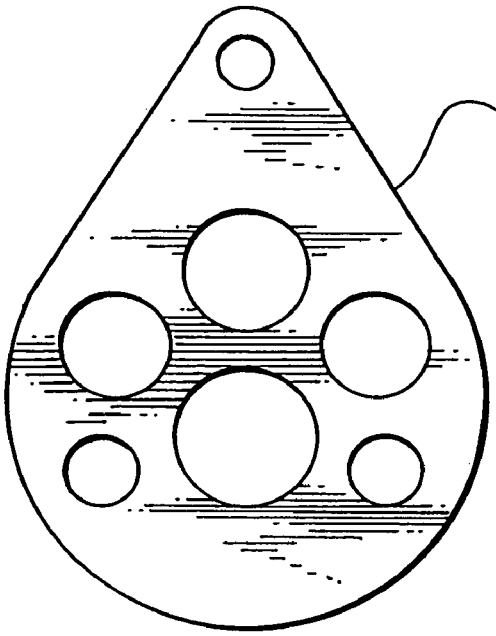
FIG. 9 is a schematic depiction of the guide roller of the present invention.
Figure 10:
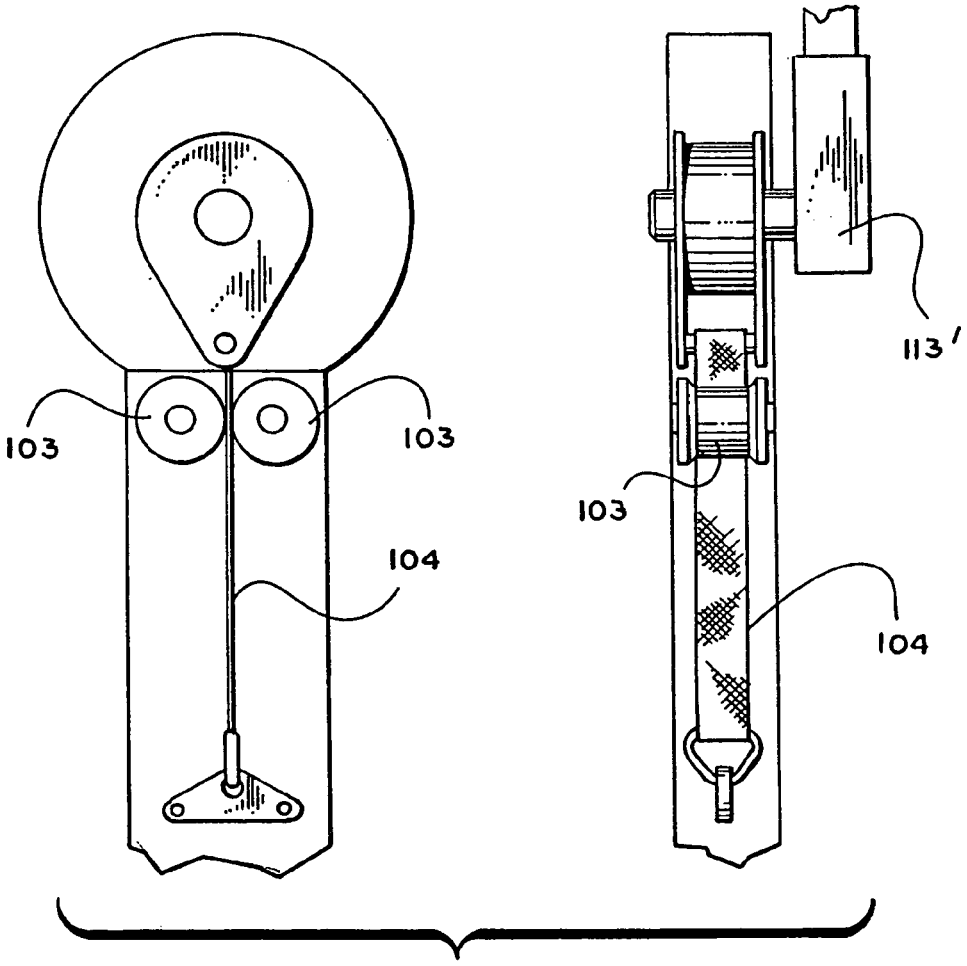
FIG. 10 is a schematic depiction of the drive linkage, guide rollers, driveshaft and connections to the actuator arm.
Figure 13:
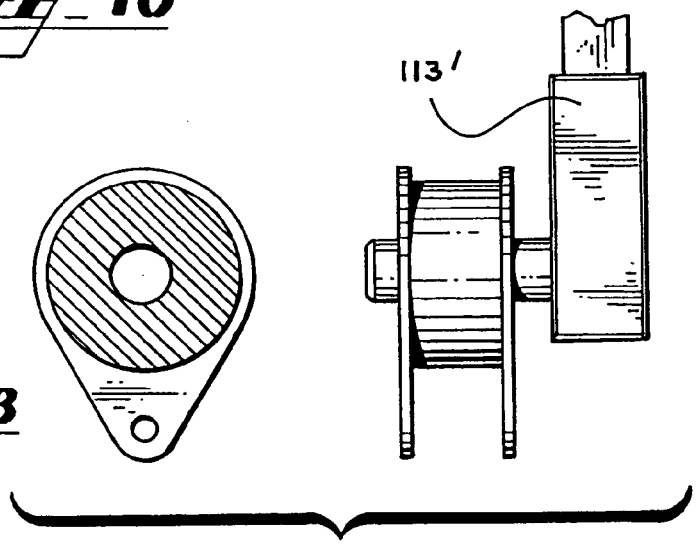
FIG. 13 is a side and front schematic depiction of the two-way cam spool of life present invention.
Figure 11:
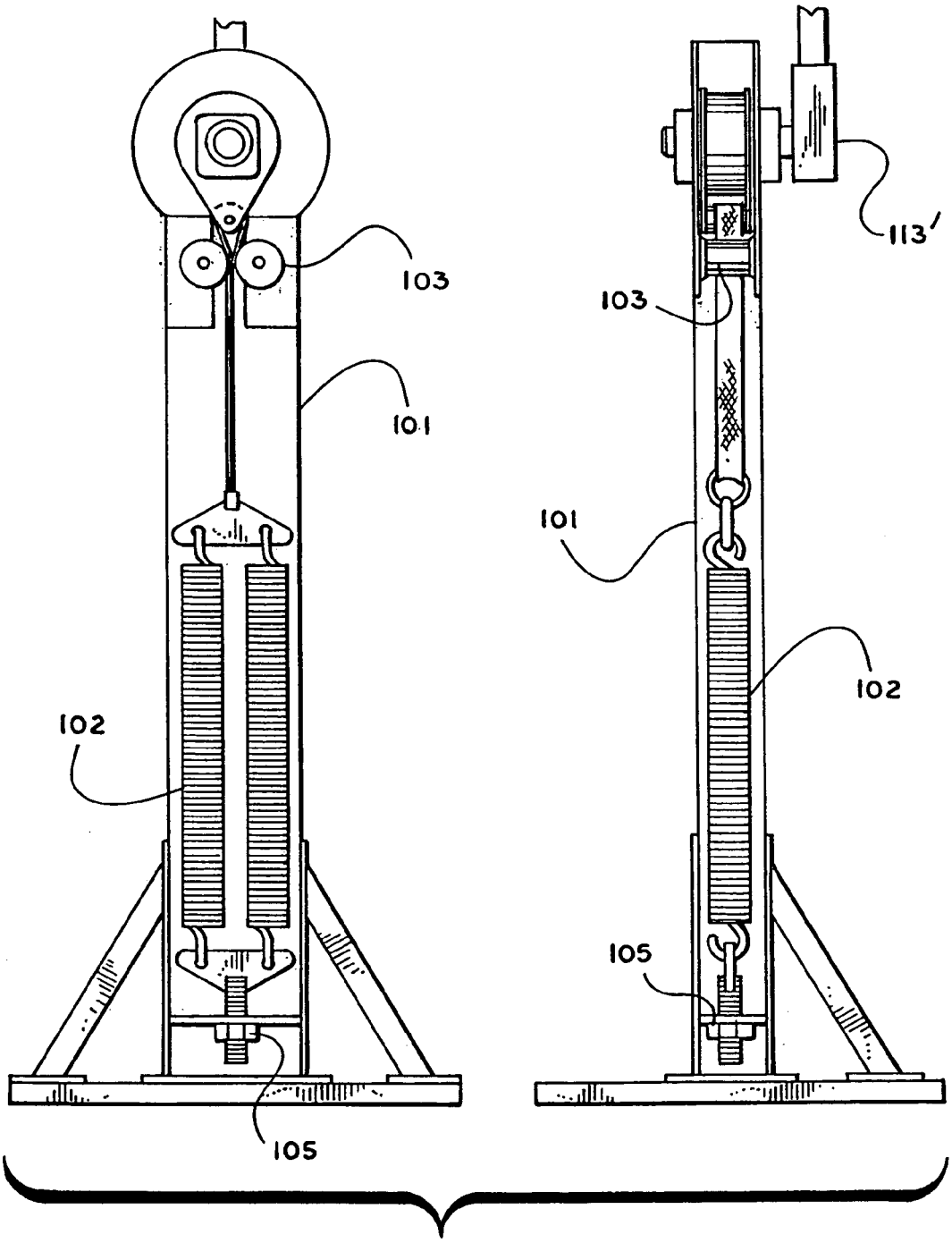
FIG. 11 is a side and frontal schematic depiction of one embodiment of the apparatus of the present invention.

As shown in FIG. 1, the tension on the resistance means can be adjusted by known means, including the tension anchor, bolt and nut arrangement, which increases or decreases the tension on the resistance means. The support base may rest upon a flat, horizontal surface, be attached to a horizontal surface, or be attached to a vertical surface. The actuator arm preferably has no play, i.e. any movement of the actuator arm requires effort by the user since there is preferably constant tension by the resistance means. This is preferably accomplished by the support housing of the resistance means being linked to the two-way spool whereby the flexible control linkage comes in contact with the leverage-reducing guide rollers. This prevents any movement of the actuator arm which is not under tension by the resistance means. This is shown in greater detail in FIG. 6. FIG. 6 also depicts the leverage-controlling two-way descending spool.

Figure 2:
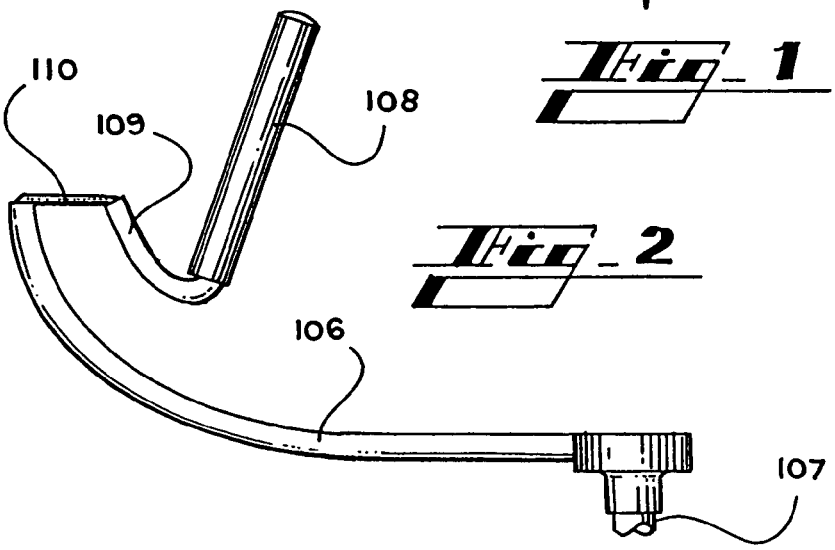
FIG. 2 is a side view of the actuator arm assembly of the present invention.
Figure 5:
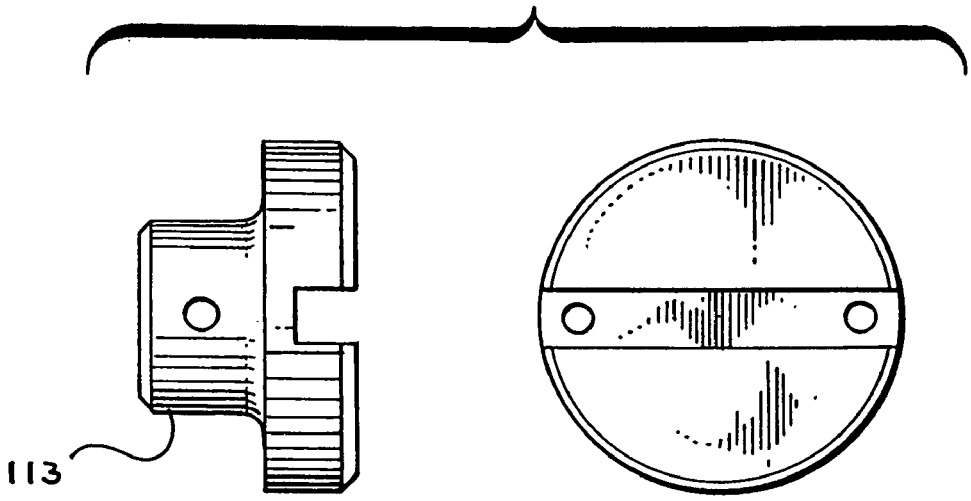
FIG. 5 is a top view and side view of the attachment means between the actuator arm and the drive shaft.

Although FIG. 2 shows the padded two-hand grip, it is envisioned that other types of grip may be substituted therefore such as a one-handed grip, a v-type grip, a straight, cooked, or angled bar or the like in order to facilitate other types of training or exercise while using the present invention.

FIG. 3 further depicts the connection between the two-way spool, the flexible control linkage, and the two-way spool housing.

The two-way spool and the leverage-reducing guide rollers may be made of any appropriate, machinable material. Advantageously such appropriate materials are aluminum or aluminum alloys, polymers, plastics, fiberglass, copper, copper alloys, iron, steel, and the like. Preferably the leverage-reducing guide rollers and the two-way descending spool are made of ultra-high molecular weight polymers such as polyamides, nylons, Delrin, and the like.

The materials of construction of the remaining portion of the apparatus of the present invention such as the actuator arm, support base, and support housing are advantageously metal or high-strength polymers. The bearing units and arm/shaft connector are likewise advantageously metallic or high-strength plastics and preferably are manufactured of a steel alloy.

As shown in FIG. 1 the support base advantageously contains tilt-adjustable anchor holes for use of the present invention in other than a 90 degree setting from the support base. This is particularly advantageous for certain exercises and certain sports training.

The apparatus of the present invention emulates the range of motion of an actual swing thus allowing the individual to exercise the precise muscle groups and joints involved in a particular sport such as golf, baseball, tennis, and the like. The adjustable graduated resistance force strengthens muscle groups in the correct ratio to the various stages of the proper swing and trains muscle memory for proper plane rotation through the full range of motion and ball strike zone. The present invention develops strength and endurance for powerful, repeated ball striking without fatigue and strengthens the lower back, trunk, leg and shoulder muscles, which are critical to the full body rotation of a correct swing. Importantly, the grip of the present invention virtually eliminates the risk of wrist strain, tendonitis and hand fatigue during training while strengthening and toning muscles in the neck, shoulders, arms, back, abs, obliques, sides, hips, thighs, calves and feet. The present invention provides for simultaneous left/right swing, thereby strengthening muscles of both sides of the body for balanced development. The apparatus may be used to warm up before actually playing a sport and tones, strengthens and develops stamina and endurance allowing one to play with less fatigue, play longer and avoid injuries related to the swing motion. The apparatus has an oversized tubular, preferably steel, framework which gives a stable base for serious workouts, is suitable for the home or a gym, and is built sturdy and engineered for years of maintenance free operation. Advantageously the moving parts are heavily padded with special shock absorbing foam for maximum in safety and operator comfort.

The present invention provides an unparalleled workout to strengthen and tone the muscle groups associated with the various sports swings, and to maintain joint fluidity and muscle memory to reinforce the proper on plane swinging movement. This permits the playing swing to be executed painlessly, powerfully and repeatedly with reduced risk of soreness or injury. Using the present invention aspiring athletes can develop proper swing mechanics, while toning and coordinating movement of their muscles and joints. By engineering in the proper swing plane the present apparatus relieves a child from the mental burden of keeping so many concepts organized and allows them to focus on executing a mechanically guided swing at slow motion speeds, which quickly instills the proper motion memory needed to build confidence and become better, more powerful ball hitters.

The present apparatus is engineered to strengthen every muscle group associated with the whole body range of motion as one makes a powerful swing. The entire body works in coordinated rhythm to anchor, support, balance and move through the swinging stroke. During this motion most of the muscle groups in the body come into play to some degree. While certain muscles balance and support, others counter and control as the key muscles drive hard from wind up to follow through.

By training with the present invention's variable resistance one can execute a mock swing at approximately one quarter speed with every affected group of muscle tissue having the opportunity to contract and relax in the proper functional order. The order of muscle actuation is critical to the development of a strong, safe swing.

The present apparatus allows one to train both left and right handed interchangeably without disturbing one's stance, therefore it is possible to alternate left and right handed swings to strengthen both sides of the body uniformly.

The main drawback in developing specific muscles or isolated muscle groups with typical gym style equipment is that even though these targeted muscles may be independently stronger, they lack the elasticity and muscle memory to execute the exact range of motion of the entire body that comes into play as you coil and release from head to toe making your swing. There is an intricate physiological relationship between structural bones, pivotal joints and powerful muscles in any particular complex motion. The only way to train, tone and strengthen the body for a specific range of motion is to train in the exact range of motion while employing some form of resistance. This resistance, when set appropriately to your physical structure, stresses all of the joints and muscle tissue associated with the swing and contributes to the development of muscle memory and properly functioning joint and muscle interactivity.

The present invention through repetition of the pre-aligned course of motion establishes, develops and encourages a proper swing in the correct swing plan which is critical to accurate, consistent and powerful ball striking. This repetition develops muscle memory and repeatable swing dynamics in the individual enabling him or her to duplicate this proper on plane swing over and over during the course of play without fatigue.

Use of the present invention tones, strengthens, develops and maintains fit, flexible muscle tissue. In addition, the rotational, pivotal, flexor and extender joints, which operate during a swing, are kept fluid and functional. By adjusting the resistance tension on the present apparatus, it is possible to customize one's workout for challenging strength training, mere flexibility and maintenance, or alternate strong and light days to achieve personal goals. Advantageously the present invention employs at least one powerful resistance coil which is light weight so the apparatus can be moved easily. The adjustable tension makes it possible to tailor the devices required operating force to allow men, women, seniors, and young people to benefit by gaining or regaining strong, smooth swings. It is fast and easy to increase or decrease the actuation resistance so one can continue in the evolution of power development in the swing related muscle groups or simply maintain fitness for fatigue-free play.

In strength training for the swing motion, it is critical to recognize the wrist as the weakest link in the equation. Here-to-fore, swing training devices have had the weight beyond the grip which, when operated, strains the delicate wrist tendons and squeezing muscles in the hands and fingers which can quickly generate fatigue, cramping and even tendonitis which can cause considerable soreness and in some cases, cripple the wrists. With the grip of the present invention, this weak link of the wrist is eliminated in that the wrists are not strained in pushing down or pulling up on the grip in order to manipulate the resistance. By allowing the wrists, hands, and fingers to assume a torque-free grip, the weight load is transferred to the more robust muscle groups of the forearms, upper arms, shoulders and trunk. This means that these major power muscles are exercised and stressed while the weaker wrist joint and hands are protected.

Figure 12B:
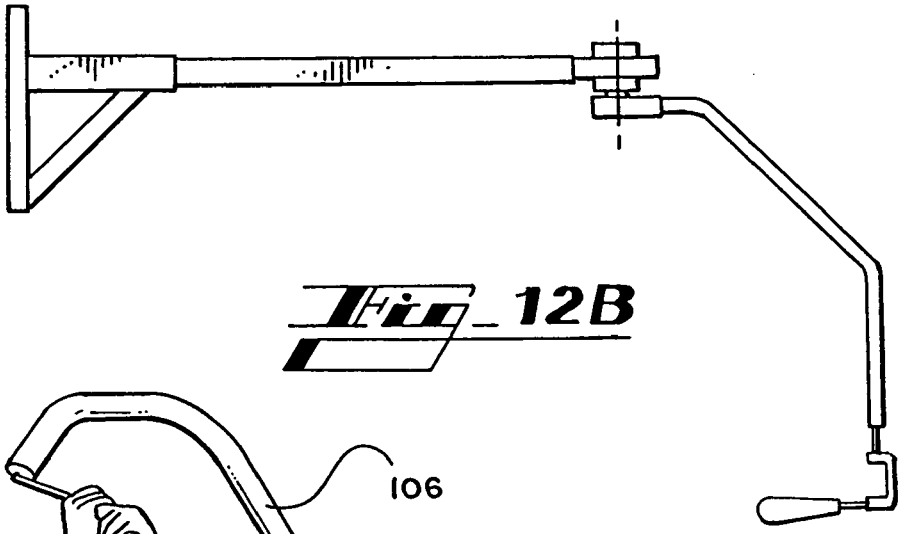
FIG. 12 is a depiction of the present invention as it may be used by an individual for golf-type swinging exercises and mounted vertically for use as baseball, softball, tennis, or the like swinging exercise.
Figure 12A:
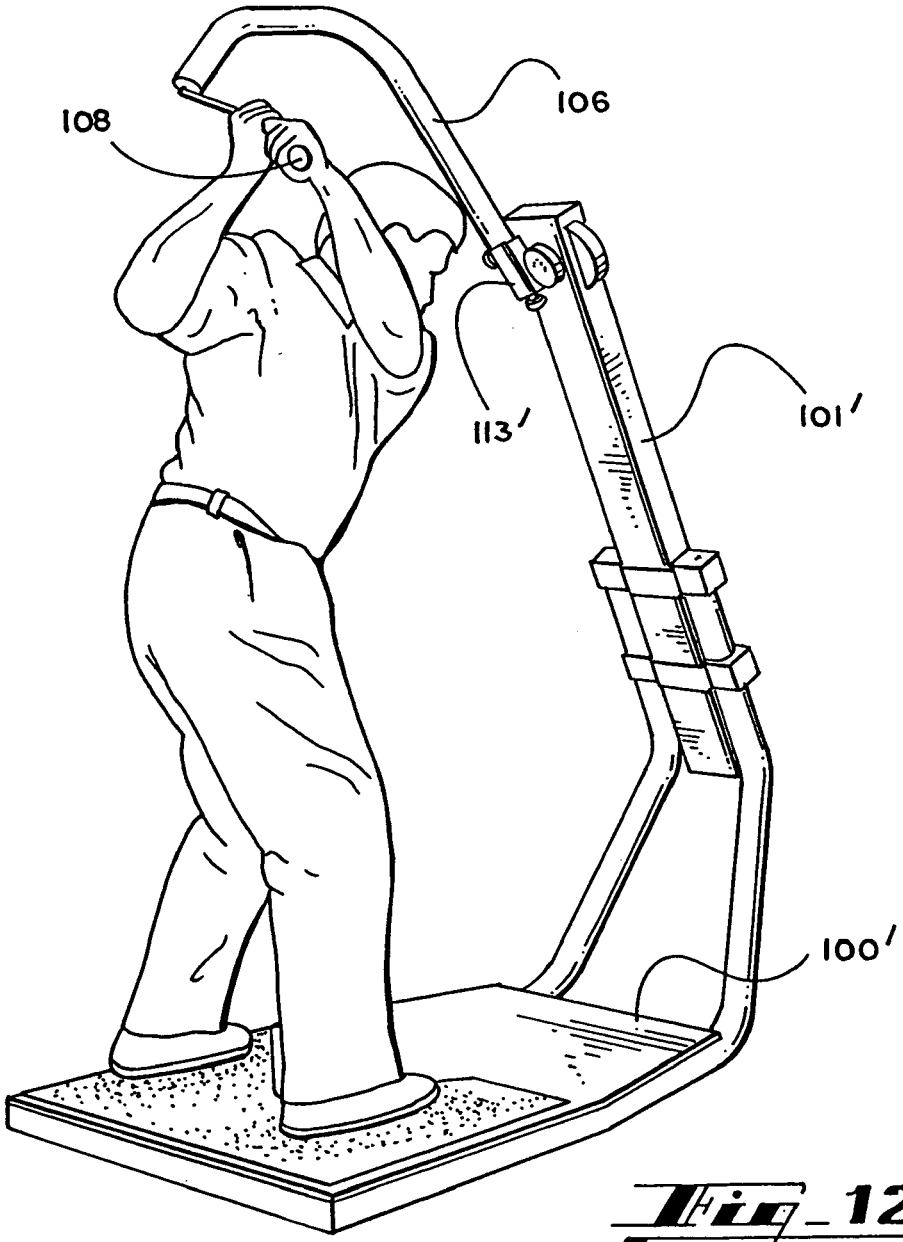
Figure 14:
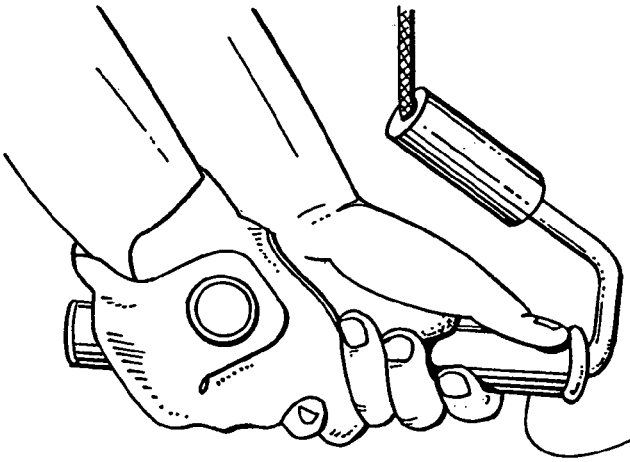
FIG. 14 shows the offset grip in use in the golf application, indicating the grip balance point.
Figure 15:
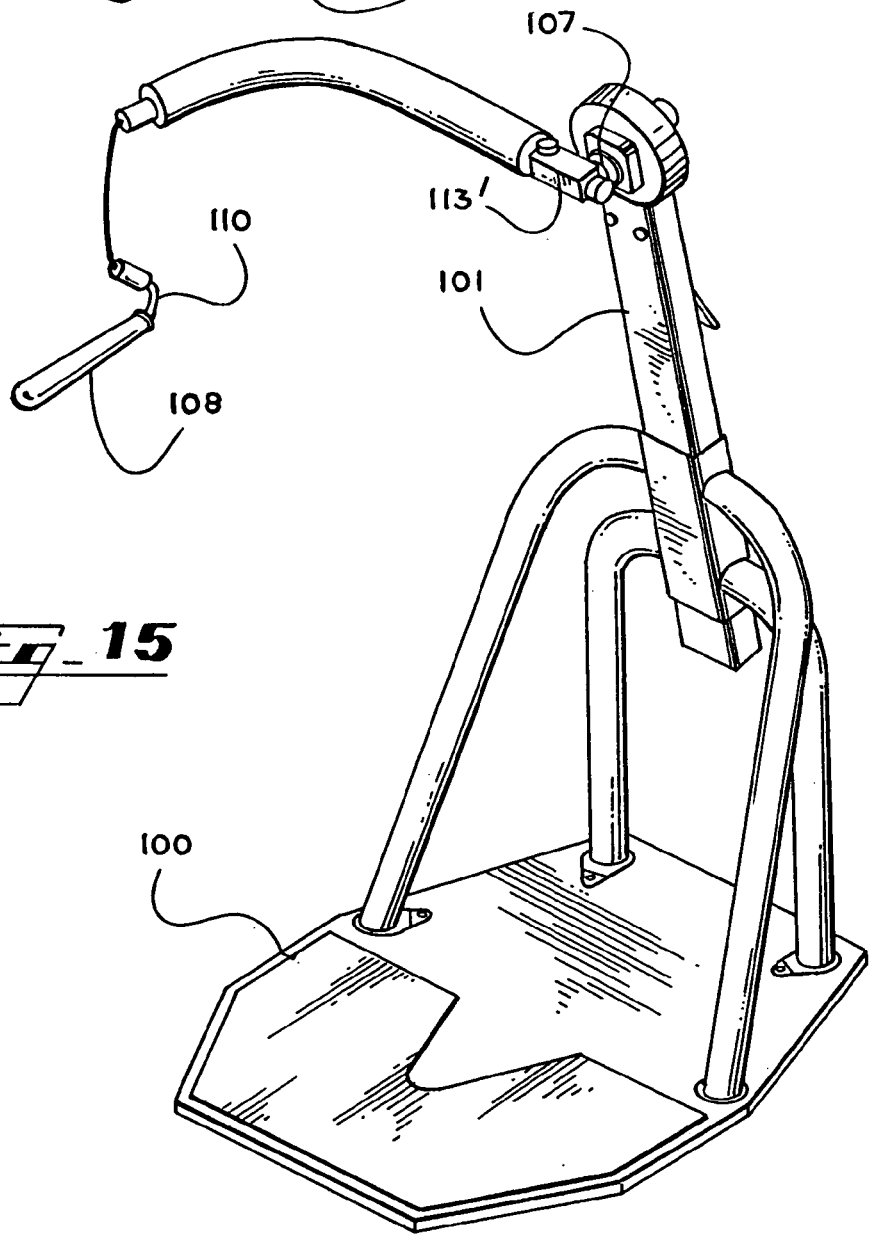
FIG. 15 is a perspective view of one embodiment of the present invention.
Figure 17:
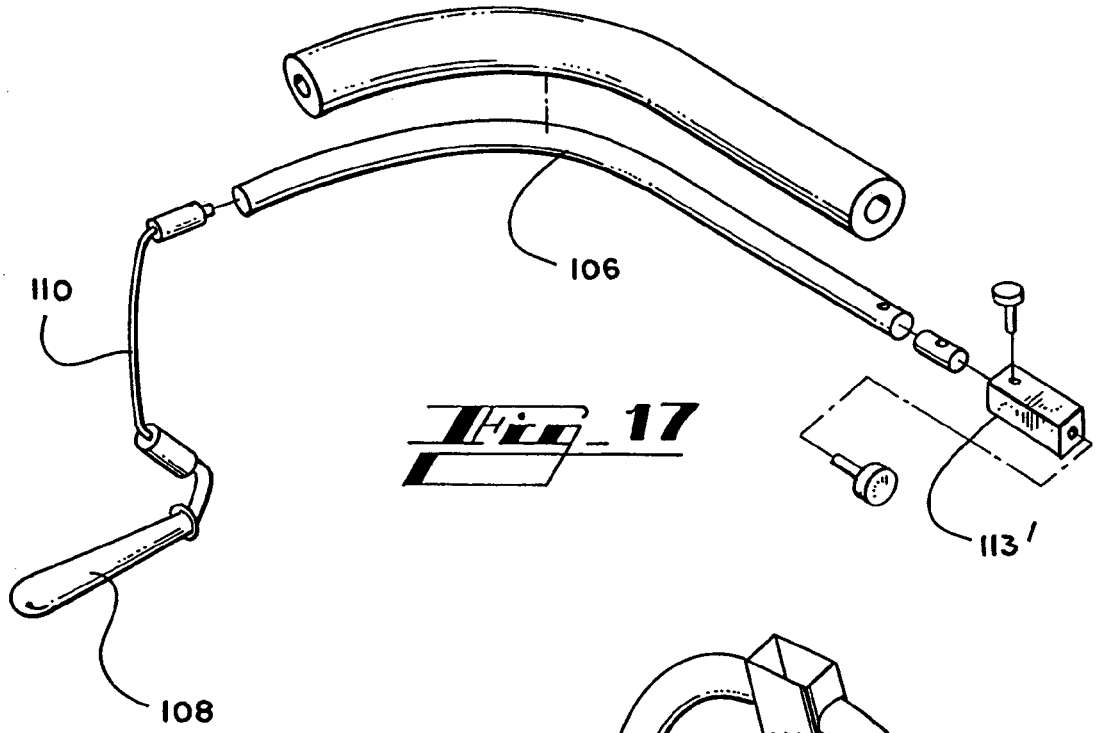
FIG. 17 is an exploded view of the swing arm and handle of the present invention.
Figure 16:
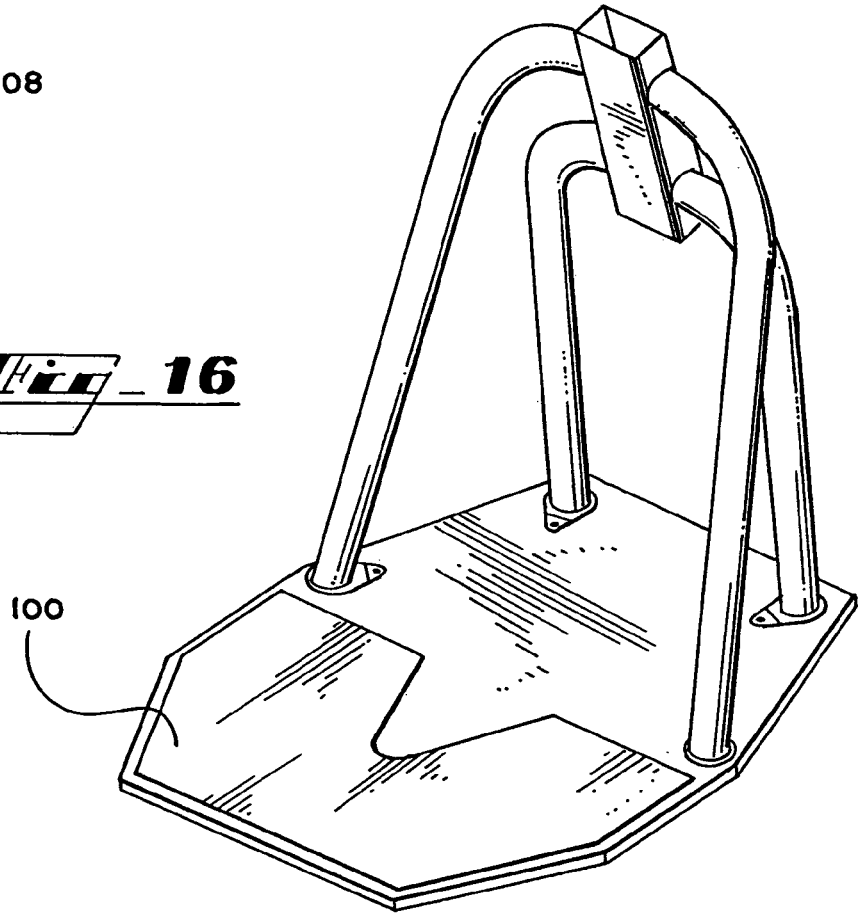
FIG. 16 is an exploded view of the base of one embodiment of the apparatus of the present invention.
Figure 18:
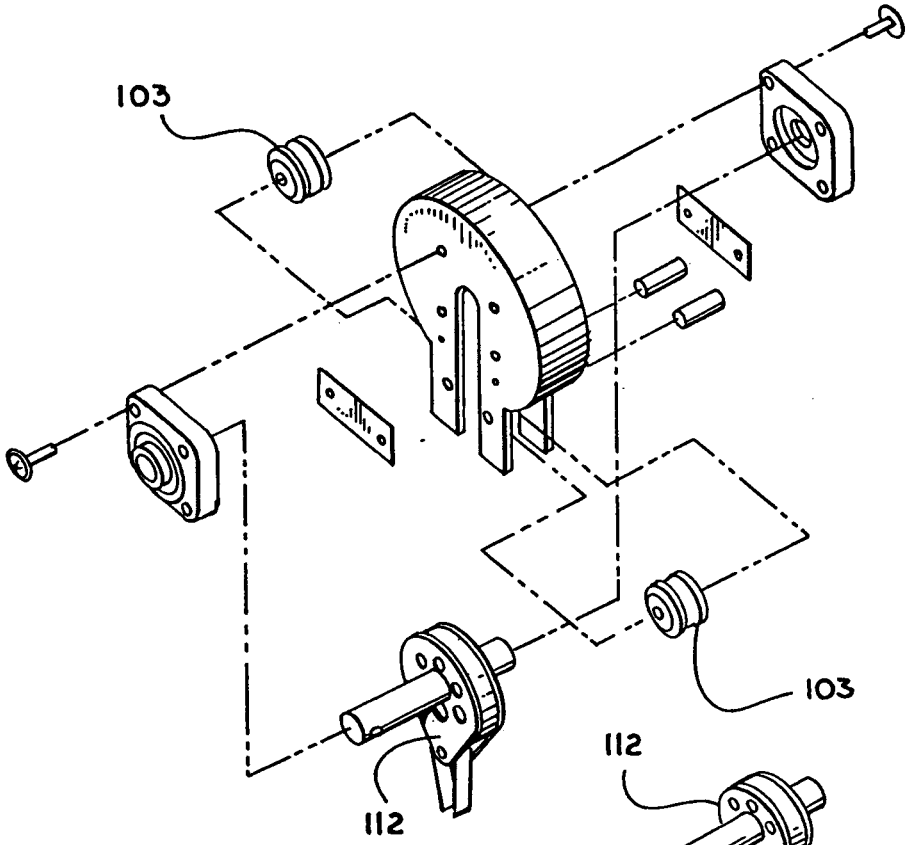
FIG. 18 is an exploded view of a two-way spool of the present invention showing the attachments thereto.
Figure 19:
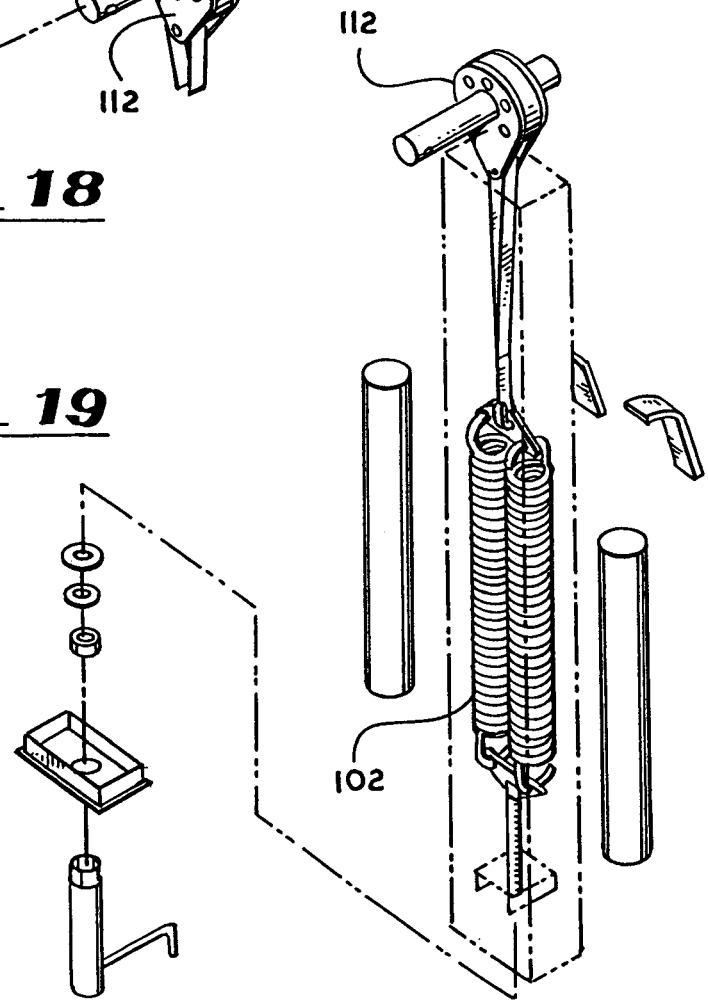
FIG. 19 is an exploded view of the two-way spool, resistance coils, adjustment means, and various attachments thereto.
Figures 20, 21:
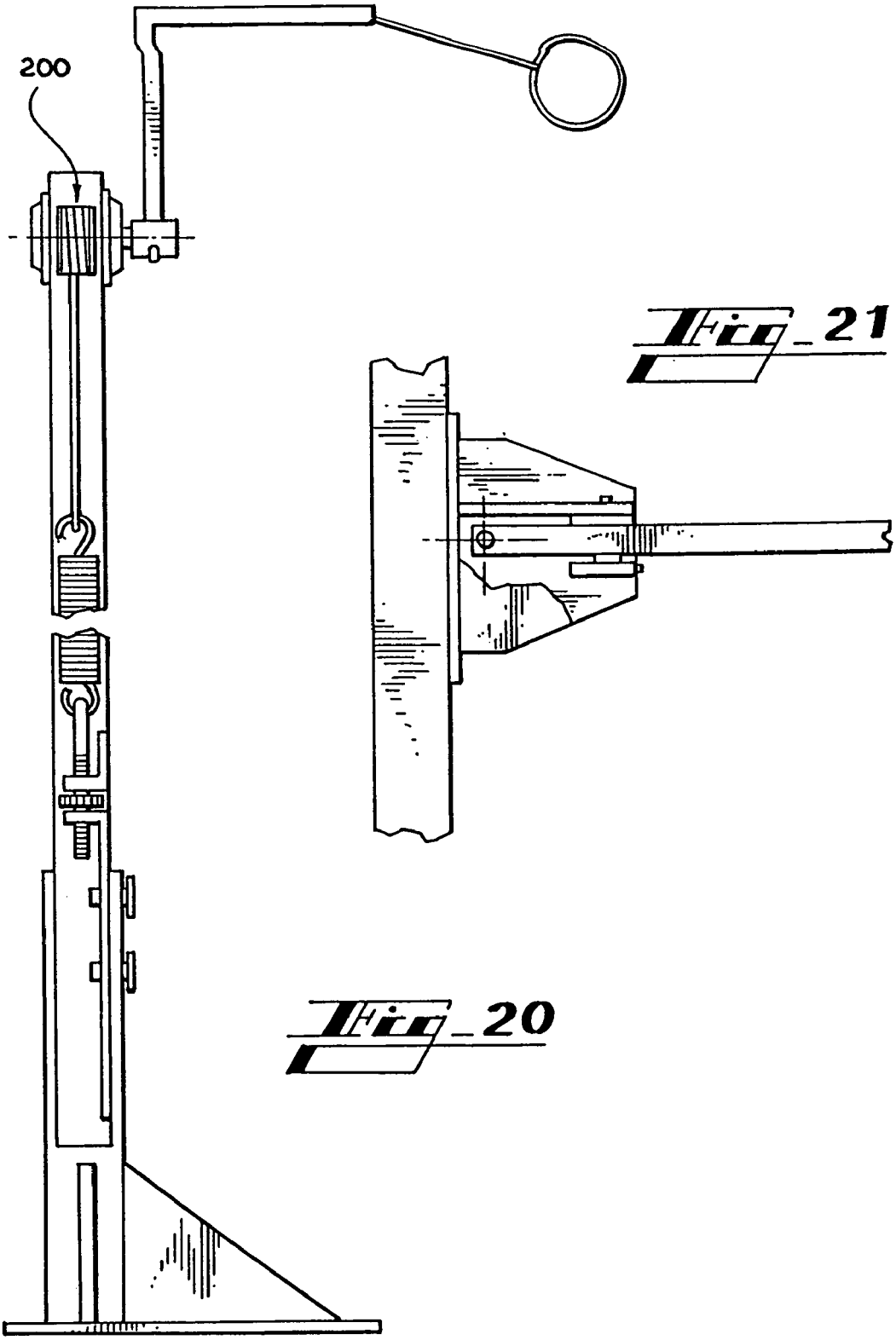
FIG. 20 is a side view of another embodiment of the present invention which is attached to a wall wherein the apparatus extends horizontally. When in this position the apparatus is particularly useful in training for baseball, tennis, handball and the like to strengthen and improve the swinging motion required in those sports.
FIG. 21 shows the range of motion of the actuator arm of one embodiment of the present invention. This range of motion, or slip zone, is provided by the incorporation of the slip sleeve arm mount, the stop pin and the shaft. The slip sleeve arm mount has a opening or journal which allows a range of motion before the resistance coil is actuated.
Figure 22:
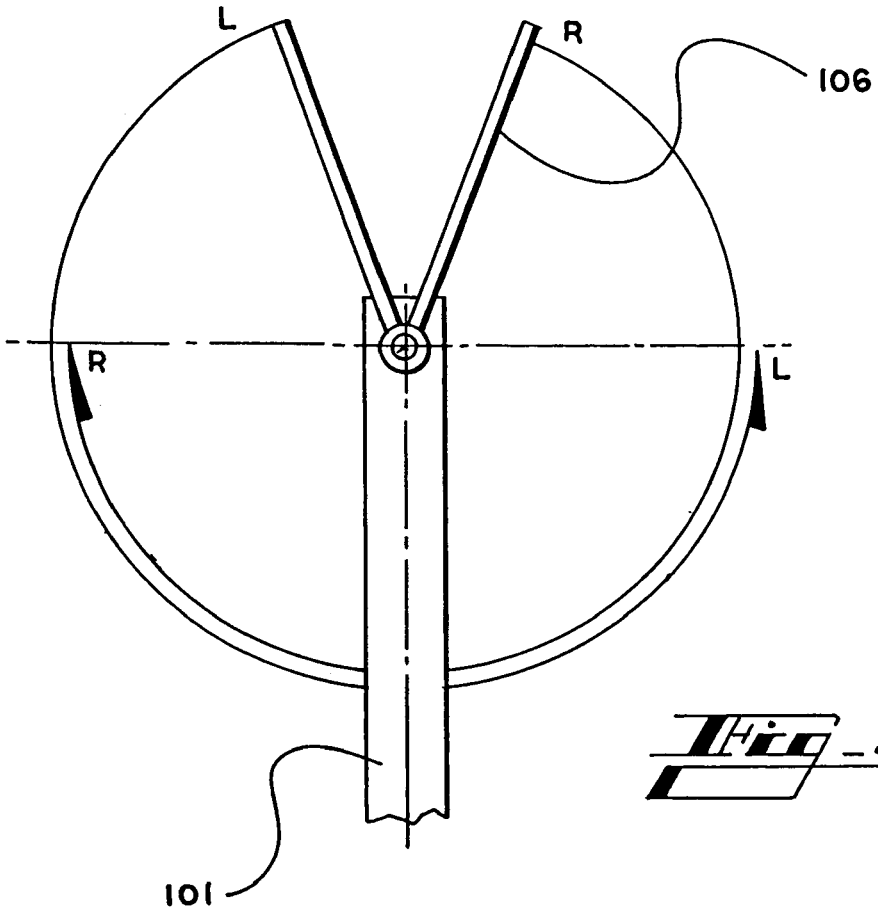
FIG. 22 is a side view of the novel two-way spool of the present invention which provides for both clockwise and counterclockwise motion of the actuator arm.
Figure 23:
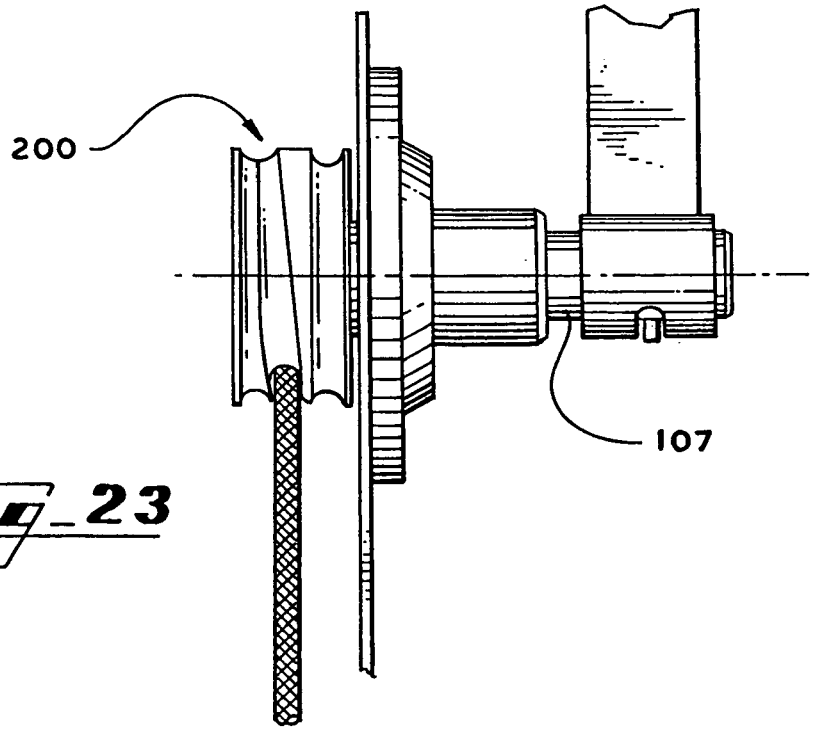
FIG. 23 is a depiction of the two-way spool of one embodiment of the present invention showing the flexible linkage and the attachment of the flexible linkage to the two-way spool. The attachment of the flexible linkage to the two-way spool is by known means.
Figure 25:
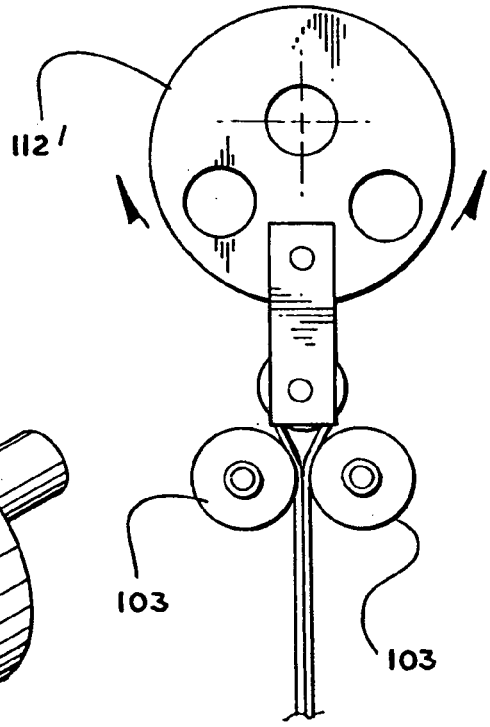
Figure 24:
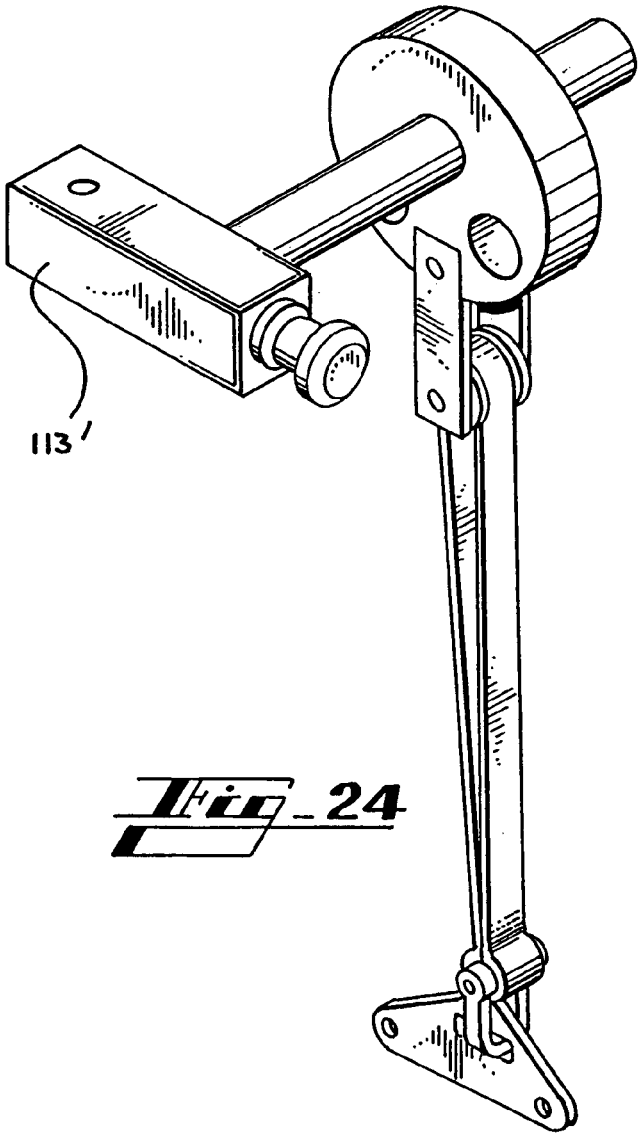
FIG. 24 is a side view of the two-way spool of one embodiment of the present invention showing the flexible linkage and leverage reducing guide rollers.

FIG. 14 illustrates an offset grip of the fitness device of the present invention in use in a golf application. As shown in FIG. 14, the handle is provided having a first free end, an elongated handle body and a second end. In view of the illustrated golf usage for this embodiment of the invention, the handle body is elongated to accommodate a two handed golf grip. FIG. 14 further illustrates the extension having a first extension end connected to the second end of the handle and a second extension end positioned for connection with line which is preferably a flexible tension line, such as a cable or the like. The tension line in conjunction with the power arm shown in FIG. 12 provides linkage to a resistance means of the present invention.

In a preferred embodiment, the extension is comprised of an angle member and a tension line receiver, preferably in the form of a cover for covering a connection between the cable line and a free end of the angle member or provides an intermediate connector bridging the tension line with the angle member. The angle member is preferably in the form of a solid or hollow bar that has a first end portion that extends into the second end of the handle and is secured in position therein. The first end portion of the bar extends generally coaxially with the axis of elongation of the handle and briefly out away from the second end. The angle member has a first leg and a first angle section that interconnects the first leg with the first end portion of the angle member. The first angle section is formed such that the first leg extends generally transverse, from an angle of about 80 to about 100 degrees being preferred, to the axis of elongation of the handle along a first plane which extends so as to bisect the handle (not shown). The angle member further includes a second angle section and a second leg with the second angle section interconnecting the first leg with the second leg. The second angle section is designed such that it has a central axis which forms an angle, preferably, an obtuse angle, relative to the central axis of the first leg. Optionally the central axis of the second leg falls along a second plane that is oblique to the aforementioned first plane on which the first axis lies. That is, with reference to FIG. 14, if the first plane bisecting the handle and the first leg is flush with the surface of the paper, the second leg will extend off the paper toward the viewer.

The tension line receiver is supported at a free end of the second leg of the angle member and provides means to cover the interconnection of the tension line with the angle member, with the interconnection being either a direct interconnection between a free end of the second leg, e.g. such as a thread loop, or an interconnection of the tension line to the tension line receiver with the latter being connected to the free end of the second leg. Advantageously the extension member may be the bar depending on the function of the cylindrical tension line receiver.

With the aforementioned first and second oblique plane relationship, the extension, particularly the angle member, is designed such that handle and extension of the illustrated offset grip are arranged in an offset fashion with respect to the tension line. Thus, a central axis of a taut tension line passes external to the grip at a height level that falls within the upper half of a vertically oriented handle main body. While FIG. 14 shows one possible angle member formation, e.g., two legs, two bends, other formations are also possible such as a single bend/single leg relationship which places the free end of the extension at a similar location.

The present apparatus allows one to switch from baseball/tennis to golf/hockey swings, without altering the equipment in any way. To switch back and forth takes about one minute (after baseball/tennis or golf/hockey bases have been established).

Since the present apparatus may be operated right and left handed simultaneously by making five or ten strokes in one direction and then alternating five or ten strokes in the opposite direction, one can achieve tremendous arm, shoulder, back, lat, oblique and ab workout.

The obliques and abdominals are important to a powerful swing since the trunk of the body drives the shoulders and arms through the swing by levering off of one's anchored stance, one can only swing as powerfully as one can twist through the swinging range of motion.

One of the most important issues in the young athlete's swing is coordinated muscle interaction. Despite the fact that younger athletes are more flexible than adults, care must still be shown to the proper mechanics of a good swing to insure that no damage is done to ambitious muscles and nerves. Another key issue in the young swing is instilling the start to finish motion of a plane swing which is accomplished by using the present apparatus. As this proper swing is repeated through the course of the workout, muscle memory is established which enables the young player to repeat the current swing on the playing field.

The present invention is a manually operated, non-electric, exercise device which, when operated in the standing position, provides graduated resistance to the operator during a simulated swing. The device guides the operator's range of motion in a correct swing plane causing the operator to use the exact muscles utilized during the swinging action. By providing resistance at different levels during the range of motion the operator benefits by developing muscle strength and tone in the proportionate ratio encountered during the actual swing whereby the operator can achieve added distance to the ball, play with less fatigue and with reduced risk of injury or joint and muscle soreness.

This invention effectively embodies the means to span the entire range of motion of the swing used in correct ball striking, and in so doing strengthens all the muscles involved in the greatly transitional range of motion where certain muscles are contracted and subsequently relaxed as other muscles of the progression are brought into play.

By embodying the exact mechanics of a proper swing and by generating resistance on the simulated downswing, this invention tones, strengthens, develops and maintains fit, flexible muscle tissue. In addition, all of the rotational, flexor and extender joints, which operate during the swing, are kept fluid and strong. This allows the operator to make more consistent and controlled swings and ensures that swing related injuries and fatigue are greatly reduced. The resistance force is graduated throughout the range of motion to present the correct ratio of strength training to the individual muscles and muscle groups thus targeting these muscles in their order of importance during the range of motion.

By adjusting the tension of the various resistance actuators in the apparatus' alternate embodiments, it is possible to tailor the device's required operating force to allow men, women, children and seniors to benefit by gaining or regaining strong, healthy swings. It is fast and easy for an operator to increase or decrease the actuation resistance so he or she may continue in the evolution of power development in the target muscles or simply maintain the various muscles for fatigue free swinging.

What is claimed is:

1. A golf or other club, bat, racket, or like swing training and exercise apparatus for simulating the proper swing path and for exercising the swing muscles, comprising:

a base;

a housing connected to the base and extending upwardly from the base;

a resistance means and a linkage means supported in said housing, the linkage means being operably connected to the resistance means at one end and to a swing arm at the other end;

said linkage means being moveable in either a clockwise or counterclockwise direction against said resistance, thereby resisting the movement of said swing arm; said linkage means being formed of a 2-way spool rigidly attached to a rotatable shaft, said linkage means further including a flexible connection means operably connected to said spool and arranged to be wound around said spool upon rotation in either a clockwise or a counterclockwise direction, said flexible connection means being connected to said resistance means whereby movement of said flexible connection means around said spool increases said resistance, providing rotational resistance to the rotational movement of the shaft;

guide rollers supported in said housing between the 2-way spool and the resistance means, said guide rollers contacting said flexible connection means such that movement of the swing arm is directly applied against the resistance means; and grip means connected to a distal end of said swing arm whereby movement of the grip means in either a clockwise or counterclockwise direction creates resistance to exercise the muscles.

2. The apparatus of claim 1 wherein said base is a platform extending in a horizontal plane and structured to support a user on a flat surface.

3. The apparatus of claim 1 wherein said swing arm is a rigid, metallic rod.

4. The apparatus of claim 1 wherein said resistance means includes a pulley attached to said shaft and a flexible connection means, one end of which is wound on said pulley and the other end of which is attached to a resistance.

5. The apparatus of claim 1 wherein said resistance means is at least one spring.

6. The apparatus of claim 5 further including means to adjust the static resistance of the at least one spring.

7. The apparatus of claim 6 wherein said adjustment means includes a pivotably mounted adjustment bolt structured to be positioned in a plurality of tension settings.

8. The apparatus of claim 1 wherein said grip means is a sphere.

9. The apparatus of claim 1 wherein said grip means is a handle.

10. The apparatus of claim 9 wherein the grip of said handle is rotatable about its horizontal axis.

11. The apparatus of claim 9 wherein said handle is offset and has a first free end, an elongated handle body and a second end, the handle body elongated to accommodate a two handed golf grip, an extension having a first extension end connected to the second end of the handle and a second extension end positioned for connection with a flexible tension line which provides linkage to the resistance means.

12. The apparatus of claim 1 wherein said flexible connection means is a rope.

13. The apparatus of claim 1 wherein said flexible connection means is a cable.

14. The apparatus of claim 1 wherein said flexible connection means is a chain.

15. The apparatus of claim 1 wherein said flexible connection means is a belt.

16. A golf or other club, bat, racket, or like swing training and exercise apparatus for simulating the proper swing path and for exercising the swing muscles, comprising:

a base;

a housing connected to the base and extending upwardly from the base;

a resistance means and a linkage means supported in said housing, the linkage means being operably connected to the resistance means at one end and to a swing arm at the other end;

said linkage means being moveable in either a clockwise or counterclockwise direction against said resistance, thereby resisting the movement of said swing arm; said linkage means being formed of a cam rigidly attached to a rotatable shaft, said linkage means further including a flexible connection means operably connected to said cam and arranged to move upon rotation of said cam in either a clockwise or a counterclockwise direction, said flexible connection means being connected to said resistance means whereby movement of said flexible connection means by said cam increases said resistance, providing rotational resistance to the rotational movement of the shaft;

guide rollers supported in said housing between the cam and the resistance means, said guide rollers contacting said flexible connection means such that movement of the swing arm is directly applied against the resistance means; and grip means connected to a distal end of said swing arm whereby movement of the grip means in either a clockwise or counterclockwise direction creates resistance to exercise the muscles.

* * * * *